US005936489A

United States Patent [19]

Lee et al.

[11] Patent Number: 5,936,489

[45] Date of Patent: Aug. 10, 1999

[54] DIELECTRIC MICROWAVE FILTER

[75] Inventors: Chang-Hwa Lee; Dong-Suk Jun; Sang-Seok Lee; Tae-Goo Choy, all of Daejeon, Rep. of Korea

[73] Assignees: Electronics & Telecommunications Research Institute, Daejeon; Korea Telecommunication Authority, Seoul, both of Rep. of Korea

[21] Appl. No.: 08/713,034

[22] Filed: Sep. 12, 1996

[30] Foreign Application Priority Data

Nov. 3, 1995 [KR] Rep. of Korea ..... 95-39679

[51] Int. Cl.[6] ..... H01P 1/20; H01P 1/205

[52] U.S. Cl. ..... 333/202; 333/206

[58] Field of Search ..... 333/202, 204, 333/206, 219, 222

[56] References Cited

U.S. PATENT DOCUMENTS

| | | | |
|---|---|---|---|
| 5,486,799 | 1/1996 | Komazaki et al. | 333/206 X |
| 5,512,866 | 4/1996 | Vangala et al. | 333/206 X |

FOREIGN PATENT DOCUMENTS

| | | | |
|---|---|---|---|
| 61-161803 | 7/1986 | Japan | 333/204 |
| 61-201501 | 9/1986 | Japan | 333/204 |
| 62-157401 | 7/1987 | Japan | 333/202 |
| 4-103201 | 4/1992 | Japan | 333/206 |
| 4-188902 | 7/1992 | Japan | 333/202 |
| 4-188903 | 7/1992 | Japan | 333/206 |
| 4-220001 | 8/1992 | Japan | 333/202 |

*Primary Examiner*—Seungsook Ham
*Attorney, Agent, or Firm*—Nixon & Vanderhye PC

[57] ABSTRACT

A dielectric microwave filter includes a dielectric body, a trinity of first, second and third resonant slots, a pair of cavities for transmitting input/output signals, a pair of slits, and a trinity of first, second and third resonant holes. Each of the resonant slots (and an associated resonant hole in some embodiments) functions as a resonator having a quarter wavelength. Each of the slits modulates a coupling of electromagnetic fields among the resonant slots (and resonant holes if present). All surfaces of the dielectric microwave filter are completely covered with an electrically conducting material, except for front and top surfaces of the dielectric body. Since the resonators having a quarter wavelength may have reduced surface dimensions, the filter may accommodate associated surface input/output coupling cavities and also be more easily manufactured in a miniaturized structure. In addition, since the filter provides inductive coupling between resonators, it may better preserve a desired overall filter performance.

18 Claims, 4 Drawing Sheets

DIELECTRIC MICROWAVE FILTER

BACKGROUND OF THE INVENTION

1. Field of the Invention

The present invention relates to a dielectric microwave filter; and, more particularly, to a dielectric microwave filter, having a miniaturized structure but increased performance and which effectively modulates coupling of electromagnetic fields between input/output terminals and a resonator, and which can be manufactured in an easy and simplified manner.

2. Description of the Prior Art

In general, a dielectric microwave filter includes a dielectric coaxial resonator of TEM mode, wherein the number of the dielectric coaxial resonators is determined by the desired properties of the dielectric microwave filter, and at least two dielectric coaxial resonators are required to form a dielectric microwave filter.

In FIGS. 1 and 2, there are provided schematic perspective views of dielectric microwave filters previously disclosed.

In FIG. 1, there is presented a schematic perspective view of a dielectric microwave filter in accordance with one embodiment of the prior art.

The dielectric microwave filter includes a dielectric body 1, a plurality of resonators 2, apertures 3, dielectric members 4 and conductive sticks 5, wherein the dielectric body 1 has a top surface 1', and the resonators 2 have parallel axes.

A trinity of first, second and third parallel resonators 2, a pair of apertures 3, a pair of dielectric members 4 and a pair of conductive sticks 5 are provided in the dielectric microwave filter of FIG. 1.

Each of the resonators 2 extends from the top surface 1' of dielectric body 1 to the bottom of dielectric body 1, and has an inner surface coated with an electrically conducting material, e.g., Au, thereby allowing it to be operated as a resonator having a quarter wavelength.

Each of the conductive sticks 5 is inserted into the first and the third resonators 2 in the dielectric body 1 with a dielectric member 4 intervening therebetween, and functions as an input/output terminal. The dielectric member 4 joins conductive stick 5 and resonator 2.

Each of the apertures 3 is located between the resonators 2, thereby modulating coupling of electromagnetic fields between the resonators 2, and is parallel with the resonators 2.

An electrically conducting material, e.g., Au, completely covers all surfaces of the dielectric microwave filter, except for an inner surface of each of the apertures 3 and the top surface 1' of the dielectric body 1.

In the above-described dielectric microwave filter, an electrical signal is applied to the conductive stick 5 inserted into the first resonator 2, which functions as an input terminal, and is, then, transmitted to the first resonator 2 by coupling of electromagnetic fields therebetween, to transmit an electrical signal from the first resonator 2 to the third resonator 2 by coupling of electromagnetic fields among the resonators 2, wherein the electrical signal transmitted from the first resonator 2 to the third resonator 3 is selectively attenuated by each of the apertures 3.

Thereafter, the electrical signal transmitted from the first resonator 2 to the third resonator 2 is applied to conductive stick 5 inserted into the third resonator 2, which functions as an output terminal.

In FIG. 7 there is shown a schematic diagram of the dielectric microwave filter shown in FIG. 1.

The coupling of electromagnetic fields between the resonators (102) having a quarter wavelength is represented by comb lines 104, and each of the resonators (102) is electrically connected to ground. The connection of an input/output terminal and the resonators (102) using the coupling of electromagnetic fields therebetween is represented by capacitances 103.

In the above-described dielectric microwave filter, the coupling of electromagnetic fields among the resonators 2 is decreased by increasing the size of each of the apertures 3 formed between the resonators 2. Furthermore, the coupling of electromagnetic fields among the resonators 2 is also determined by changing the position of each of the apertures 3 between the resonators 2.

There are certain deficiencies associated with the above-described dielectric microwave filter. Since the size and the position of each of the apertures 3 formed between the resonators 2 are limited within the finite dielectric body 1, the control of coupling of electromagnetic fields among the resonators 2 also encounters limitations, and it is also difficult to manufacture the dielectric microwave filter in miniaturized size.

Furthermore, during manufacture of the dielectric microwave filter, since all surfaces thereof, except for an inner surface of each of the apertures 3 and the top surface 1' of the dielectric body 1 are completely covered with an electrically conducting material, e.g., Au, removal of the electrically conducting material formed on the inner surface of each of the apertures 3 and the top surface 1' of the dielectric body 1 is required during manufacture. This may further compound the already complicated overall manufacturing process of the dielectric microwave filter.

In addition to the above described deficiencies in manufacture, the dielectric microwave filter thus prepared has a major shortcoming in that transmission of an electrical signal may occur through the electrically conducting material coated thereon, not through the resonators 2, which will, in turn, degrade the overall desired performance of the dielectric microwave filter.

In FIG. 2, there is presented a schematic perspective view of a dielectric microwave filter in accordance with another embodiment of the prior art.

The dielectric microwave filter of FIG. 2 includes a dielectric body 1*a*, a plurality of resonators 2*a*, grooves 6, dielectric members 4*a* and conductive sticks 5*a*, wherein the dielectric body has a top surface 1'*a* and front and rear surfaces, and the axes of each of the resonators 2*a* are parallel with each other.

A trinity of first, second and third parallel resonators 2*a*, two pairs of grooves 6, a pair of dielectric members 4*a* and a pair of conductive sticks 5*a* are included in the dielectric microwave filter of FIG. 2.

Each of the resonators 2*a* extends from the top surface 1'*a* of the dielectric body 1*a* to the bottom of the dielectric body 1*a*.

Each of the conductive sticks 5*a* is inserted into the first and the third resonators 2*a* in the dielectric body 1*a* with the dielectric member 4*a* intervening therebetween to function as an input/output terminal. The dielectric member 4*a* joins conductive stick 5*a* and resonator 2*a*.

Each pair of grooves 6 is located on the front and rear surfaces of dielectric body 1*a*, wherein each of grooves 6 is positioned between resonators 5*a*, thereby modulating the coupling of electromagnetic fields between parallel resonators 2*a*.

In the above-described dielectric microwave filter, since the dielectric body 1*a* has two pairs of grooves 6 formed on the front and the rear surfaces instead of having a pair of apertures formed therein, the dielectric microwave filter could be manufactured in an easier and simplified manner. There are still certain deficiencies associated with this dielectric microwave filter, however. Since the electromagnetic fields at a center portion of the dielectric body 1*a* are larger than at front and rear portions thereof, modulation of the coupling of electromagnetic fields by using the two pairs of grooves 6 is relatively low.

Furthermore, an input electrical signal may also be transmitted through an electrically conducting material coated thereon, which will, in turn, degrade overall performance of the dielectric microwave filter.

SUMMARY OF THE INVENTION

It is, therefore, a primary object of the present invention to provide a dielectric microwave filter which can be better manufactured in a miniaturized structure.

It is another object of the present invention to provide a dielectric microwave filter having improved performance.

It is still another object of the present invention to provide a dielectric microwave filter able to more effectively modulate the coupling of electromagnetic fields between input/output terminals and resonators therein.

It is further object of the present invention to provide a dielectric microwave filter than can be manufactured in an easier and simplified manner.

In accordance with one aspect of the present invention, there is provided a dielectric microwave filter comprising: a dielectric body having a top, a bottom and a front surfaces; a trinity of first, second and third resonant slots, each of the resonant slots being formed on the top surface of the dielectric body; a trinity of first, second and third resonant holes, each of the resonant holes extending from the top surface of the dielectric body to the bottom surface of the dielectric body, and being electrically connected to a corresponding resonant slot, wherein the resonant slot and the resonant hole, which are electrically connected with each other, function as a resonator; a pair of cavities for transmitting input/output signals, each of the cavities being located on the front surface of the dielectric body, and corresponding to the first and the third resonant slots; a pair of slits, each of the slits having an inner surface coated with an electrically conducting material, each of the slits being formed on the top surface of the dielectric body in such a way that it is positioned between the resonant slots formed on the top surface of the dielectric body, thereby modulating coupling of electromagnetic fields between the resonators; and a pair of openings, each of the openings being positioned around the cavities, thereby preventing a direct electrical connection between the resonators during transmission of the input/output signals.

In accordance with another aspect of the present invention, there is provided a dielectric microwave filter comprising: a dielectric body having top, bottom, front and rear surfaces; a trinity of first, second and third resonant slots, each of the resonant slots being formed on the top surface of the dielectric body; a trinity of first, second and third resonant holes, each of the resonant holes being extending from the top surface of the dielectric body to the bottom surface of the dielectric body, and being electrically connected to a corresponding resonant slot, wherein the resonant hole and the resonant slot, which are electrically connected with each other, function as a resonator; a pair of cavities for transmitting an input/output signal, each of the cavities being located on the front surface of the dielectric body, and corresponding to the first and the third resonant slots; and a pair of slits, each of the slits having an inner surface coated with an electrically conducting material, each of the slits being formed on the rear surface of the dielectric body in such a way that it is positioned between the resonant holes formed in the dielectric body, thereby modulating coupling of electromagnetic fields between the resonators.

In accordance with still another aspect of the present invention, there is provided a dielectric microwave filter comprising: a dielectric body having top and front surfaces; a trinity of first, second and third resonant slots, each of the resonant slots being formed on the top surface of the dielectric body, wherein an end of each of the resonant slots is electrically connected to ground; a pair of cavities for transmitting an input/output signal, each of the cavities being located on the front surface of the dielectric body, and corresponding to the first and the third resonant slots; and a pair of slits, each of the slits having an inner surface coated with an electrically conducting material, each of the slits being formed on the front surface of the dielectric body in such a way that it is positioned between the resonant slots formed on the top surface of the dielectric body, thereby modulating coupling of electromagnetic fields between the resonant slots.

In accordance with a further aspect of the present invention, there is provided a dielectric microwave filter comprising: a dielectric body having top, front and rear surfaces; a trinity of first, second and third resonant slots, each of the resonant slots being formed on the top surface of the dielectric body, wherein an end of each of the resonant slots is electrically connected to ground; a pair of cavities for transmitting an input/output signal, each of the cavities being located on the front surface of the dielectric body, and corresponding to the first and the third resonant slots; and a pair of slits, each of the slits having an inner surface coated with an electrically conducting material, each of the slits being formed on the rear surface of the dielectric body in such a way that it is positioned between the resonant slots formed on the top surface of the dielectric body, thereby modulating the coupling of electromagnetic fields between the resonant slots.

BRIEF DESCRIPTION OF THE DRAWINGS

The above and other objects and features of the present invention will become apparent from the following description of the preferred embodiments given in conjunction with the accompanying drawings, wherein.

DETAILED DESCRIPTION OF THE PREFERRED EMBODIMENTS

There are provided in FIGS. 3 to 8 a schematic perspective view of dielectric microwave filters, and schematic diagrams of dielectric microwave filters, in accordance with the present invention.

Figure 1:
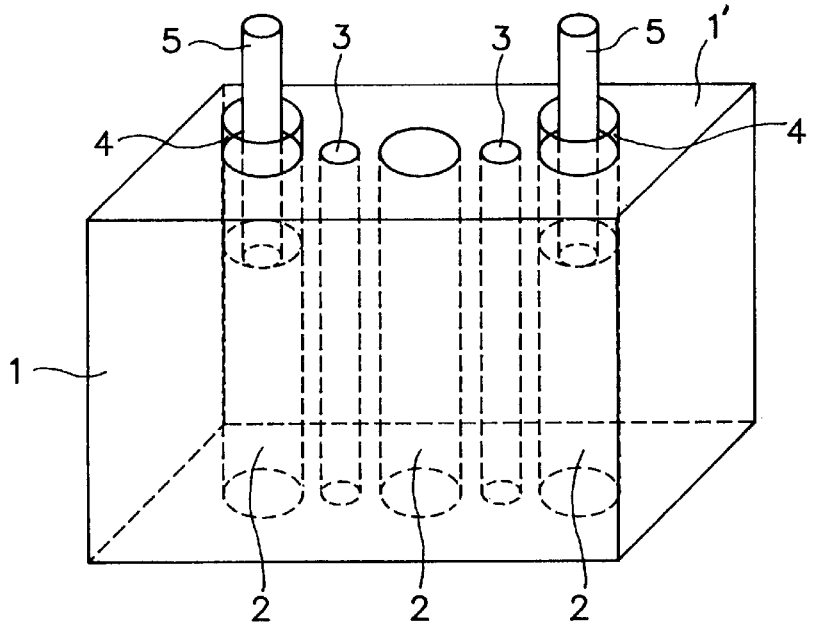
FIG. 1 (Prior Art)
FIG. 1 shows a schematic perspective view of a dielectric microwave filter in accordance with one embodiment of the prior art.
Figure 2:
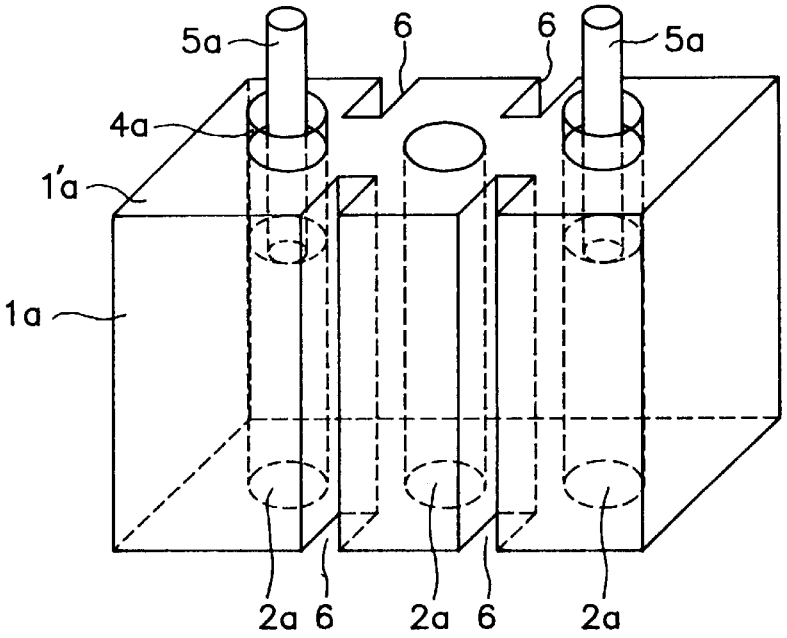
FIG. 2 (Prior Art)
FIG. 2 presents a schematic perspective view of a dielectric microwave filter in accordance with another embodiment of the prior art.
Figure 3:
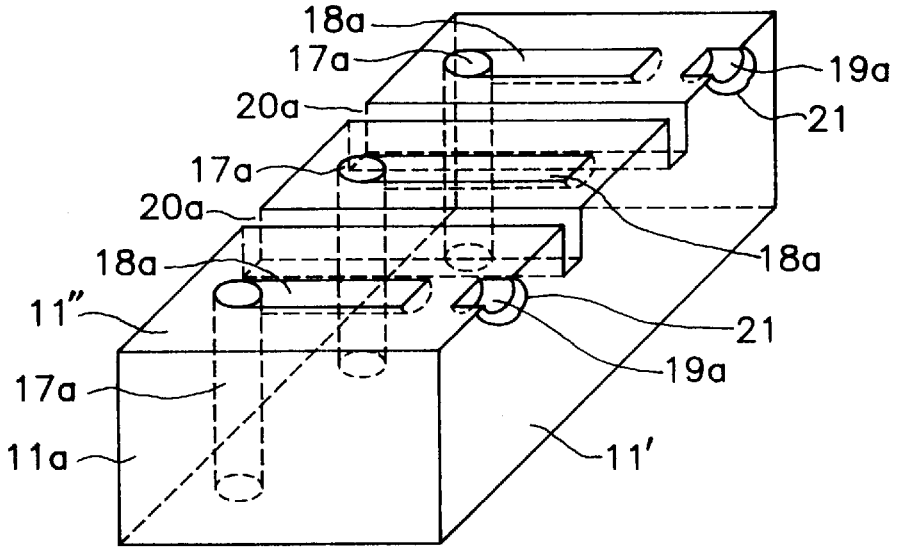
FIG. 3 provides a schematic perspective view of a dielectric microwave filter in accordance with one embodiment of the present invention.

In FIG. 3, there is provided a schematic perspective view of a dielectric microwave filter in accordance with one embodiment of the present invention, wherein the dielectric microwave filter comprises a dielectric body 11*a*, a trinity of first, second and third resonant slots 18*a*, a pair of cavities 19*a* for transmitting an input/output signal, a pair of slits 20*a*, a trinity of first, second and third resonant holes 17*a* and a pair of openings 21.

The dielectric body 11*a* has a top surface 11", a bottom surface (not shown) and a front surface 11'.

Each of the resonant slots 18*a* is formed on the top surface 11" of the dielectric body 11*a*. Each of the resonant holes 17*a* extends from the top surface 11" of the dielectric body 11*a* to the bottom surface of the dielectric body 11*a*. Each of the resonant holes 17*a* is provided with a proximal and a distal ends, wherein the proximal end of each of the resonant holes 17*a* is electrically connected to a corresponding resonant slot 18*a*, and the distal end thereof is electrically connected to ground. The resonant slot 18*a* and the resonant hole 17*a*, which are electrically connected with each other, function as a resonator (not shown) having a quarter wavelength.

Each of the cavities 19*a* for transmitting an input/output signal is located on the front surface 11' of the dielectric body 11*a*, and corresponds to the first and the third resonant slots 18*a*.

Each of the slits 20*a* is formed on the top surface 11' of the dielectric body 11*a* in such a way that it is positioned between the resonant slots 18*a* formed on the top surface 11" of the dielectric body 11*a*, thereby modulating the coupling of electromagnetic fields between the resonators.

Each of the openings 21 is positioned around the cavities 19*a*, thereby preventing a direct electrical connection between the resonators during transmission of the input/output signal.

In the above-described dielectric microwave filter, all surfaces of the dielectric microwave filter are completely covered with an electrically conducting material, e.g., Au, except for each of the openings 21 and the top surface 11" of the dielectric body 11*a*.

Figure 7:
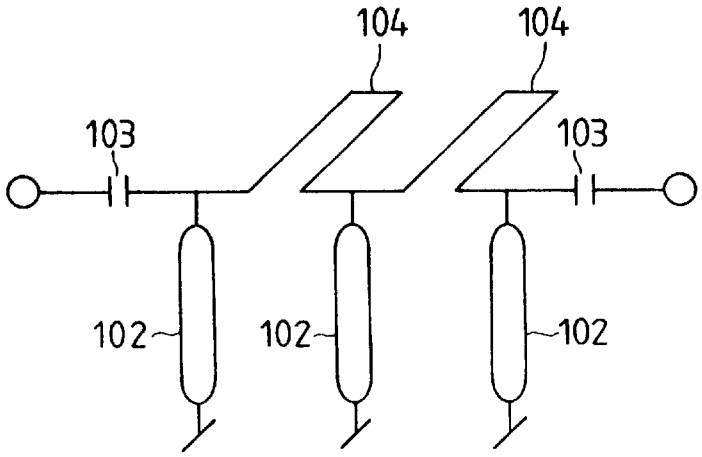
FIGS. 7 and 8 are a schematic diagram of dielectric microwave filters.

In FIG. 7, there is a schematic diagram illustrating the dielectric microwave filter as shown in FIG. 3. The coupling of electromagnetic fields between quarter wavelength resonators 102, wherein each of the quarter wavelength filters 102 is composed of a connected resonant hole and resonant slot, is represented by comb lines 104, and each of the resonators 102 is electrically connected to ground, respectively. The connection of an input/output terminal and resonators 102 by coupling of electromagnetic fields therebetween is represented by capacitances 103.

In the above-described dielectric microwave filter, since the resonant slot 18*a* and resonant hole 17*a* which function together as a resonator having a quarter wavelength in the dielectric microwave filter has a folded structure, it better allows the dielectric microwave filter to be manufactured in a miniaturized structure.

Furthermore, since each of the cavities 19*a* functions as a means for transmitting an input/output signal in the dielectric microwave filter, the manufacturing process of the dielectric microwave filter can be simplified and facilitated.

In addition, since the dielectric microwave filter provides inductive coupling between resonators, and also has the pair of openings 21 which prevents direct electrical connection among the resonators during the transmission of the input/output signal, it better preserves the overall desired filter performance.

Figure 4:
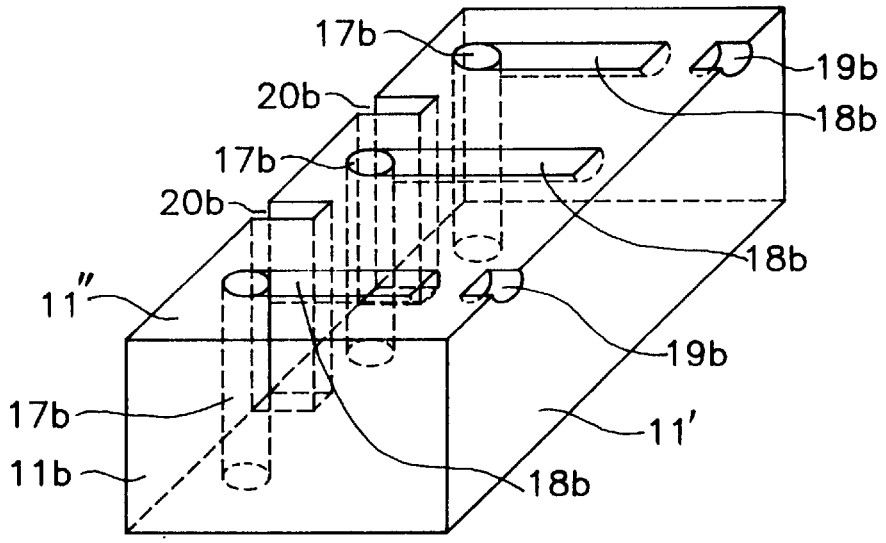
FIG. 4 offers a schematic perspective view of a dielectric microwave filter in accordance with another embodiment of the present invention.

In FIG. 4, there is offered a schematic perspective view of a dielectric microwave filter in accordance with another embodiment of the present invention, wherein the dielectric microwave filter comprises a dielectric body 11*b*, a trinity of first, second and third resonant slots 18*b*, a pair of cavities 19*b* for transmitting an input/output signal, a pair of slits 20*b*, and a trinity of first, second and third resonant holes 17*b*.

The dielectric body 11*b* has a top surface 11", a bottom surface (not shown), a front surface 11' and a rear surface (not shown).

Each of the resonant slots 18*b* is formed on the top surface 11" of the dielectric body 11*b*. Each of the resonant holes 17*b* extends from the top surface 11" of the dielectric body 11*b* to the bottom surface of the dielectric body 11*b*. Each of the resonant holes 17*b* is provided with proximal and distal ends, wherein the proximal end of each of the resonant holes 17*b* is electrically connected to a corresponding resonant slot 18*b*, and the distal end thereof is electrically connected to ground. The resonant slot 18*b* and the resonant hole 17*b*, which are electrically connected with each other, function as a resonator having a quarter wavelength.

Each of the cavities 19*b* for transmitting an input/output signal is located on the front surface 11' of the dielectric body 11*b*, and couples signals to the first and third resonant slots 18*b*.

Each of the slits 2*b* is now formed on the rear surface of the dielectric body 11*b* in such a way that it is positioned between the resonant holes 17*b* formed in the dielectric body 11*b*, thereby modulating the coupling of electromagnetic fields between the resonators.

In the above-described dielectric microwave filter, all surfaces of the dielectric microwave filter are completely covered with an electrically conducting material, e.g., Au, except for the front surface 11' and the top surface 11" of the dielectric body 11*b*.

Figure 8:
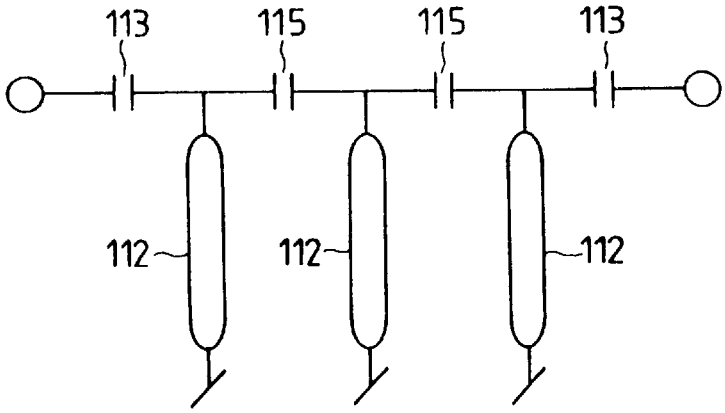

In FIG. 8, there is provided a schematic diagram illustrating the dielectric microwave filter shown in FIG. 4. The coupling of electromagnetic fields between quarter wavelength resonators 112 (which each include a resonant hole and connected resonant slot) is represented by a first capacitance 115, and each of the resonators 112 is electrically connected to ground, respectively. The connection of an input/output terminal and the resonators 112 by coupled electromagnetic fields therebetween is represented by capacitances 113.

Figure 5:
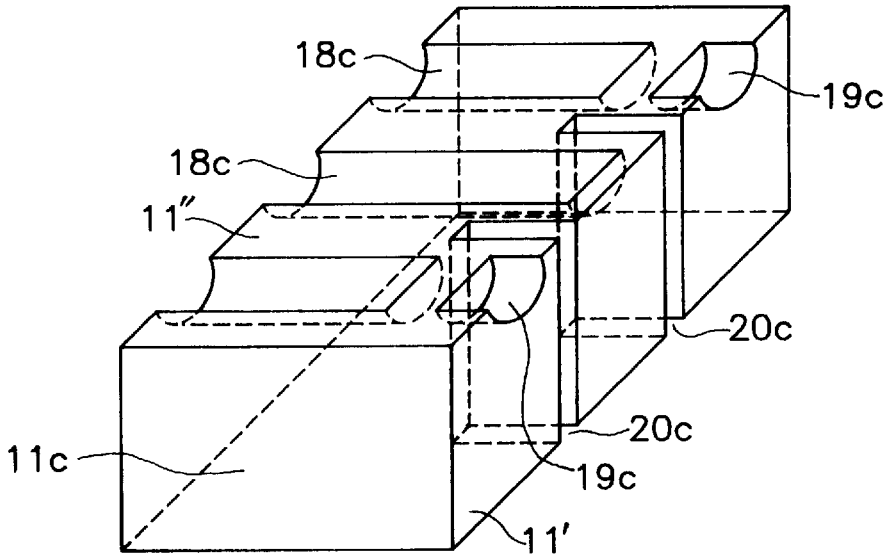
FIG. 5 produces a schematic perspective view of a dielectric microwave filter in accordance with still another embodiment of the present invention.

In FIG. 5, there is produced a schematic perspective view of a dielectric microwave filter in accordance with still another embodiment of the present invention, wherein the dielectric microwave filter comprises a dielectric body 11*c*, a trinity of first, second and third resonant slots 18*c*, a pair of cavities 19*c* for transmitting an input/output signals and a pair of slits 20*c*.

The dielectric body 11*c* has a top surface 11" and a front surface 11'.

Each of the resonant slots 18*c* is formed on the top surface 11" of the dielectric body 11*c*, and an end thereof is electrically connected to ground. Each of the resonant slots 18*c* functions as a resonator having a quarter wavelength.

Each of the cavities 19*c* for transmitting an input/output signal is located on the front surface 11' of the dielectric body 11*c*, and couples signals to the first and the third resonant slots 18*c*.

Each of the slits 20*c* is formed on the front surface 11' of the dielectric body 11*c* in such a way that it is positioned between the resonant slots 18*c* formed on the top surface 11" of the dielectric body 11*c*, thereby modulating the coupling of electromagnetic fields between the resonators.

In the above-described dielectric microwave filter, all surfaces of the dielectric microwave filter are completely covered with an electrically conducting material, e.g., Au, except for the front surface 11' and the top surface 11" of the dielectric body 11*c*.

Figure 6:
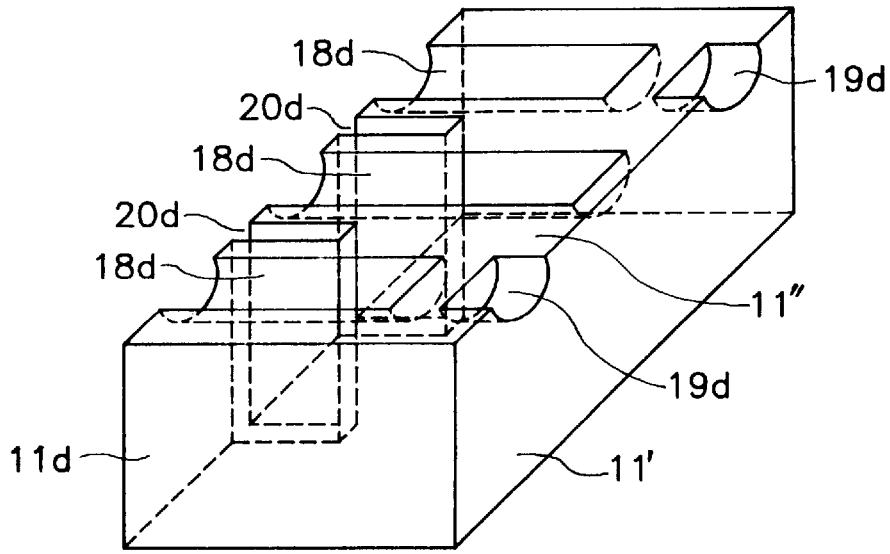
FIG. 6 represents a schematic perspective view of a dielectric microwave filter in accordance with still another embodiment of the present invention.

In FIG. 6, there is represented a schematic perspective view of a dielectric microwave filter in accordance with still another embodiment of the present invention, wherein the dielectric microwave filter comprises a dielectric body 11*d*, a trinity of first, second and third resonant slots 18*d*, a pair of cavities 19*d* for transmitting input/output signals and a pair of slits 20*d*.

The dielectric body 11*d* has a top surface 11", a front surface 11' and a rear surface (not shown).

Each of the resonant slots 18*d* is formed on the top surface 11" of the dielectric body 11*d*, and an end thereof is electrically connected to ground. Each of the resonant slots 18*d* functions fields resonator having a quarter wavelength.

Each of the cavities 19*d* for transmitting an input/output signal is located on the front surface 11' of the dielectric body 11*d*, and corresponds to the first and third resonant slots 18*d*.

Each of the slits 20*d* is formed on the rear surface of the dielectric body 11*d* in such a way that it is positioned between the resonant slots 18*d* formed on the top surface 11" of the dielectric body 11*d*, thereby modulating the coupling of electromagnetic fields between the resonators.

In the above-described dielectric microwave filter, all surfaces of the dielectric microwave filter are completely covered with an electrically conducting material, e.g., Au, except for the front surface 11' and the top surface 11" of the dielectric body 11*d*.

In the above-described dielectric microwave filters illustrated in FIGS. 3 to 6, since the dielectric microwave filter provides inductive coupling between the resonators, it can effectively modulate the coupling of electromagnetic fields between input/output terminals and resonators thereby increasing the overall filter performance.

Furthermore, since the resonant slot and resonant hole function as a resonator having a quarter wavelength in the dielectric microwave filter, it allows the dielectric microwave filter to be manufactured in a miniaturized structure.

In addition, since each of the cavities functions as a means for transmitting an input/output signal in the dielectric microwave filter, the manufacturing process of the dielectric microwave filter can be simplified and facilitated.

While the present invention has been described with respect to certain preferred embodiments only, other modifications and variations may be made without departing from the scope of the present invention as set forth in the following claims.

What is claimed is:

1. A dielectric microwave filter comprising:

a dielectric body having top, bottom and front surfaces;

a trinity of first, second and third resonant slots, each of the resonant slots being formed on the top surface of the dielectric body;

a trinity of first, second and third resonant holes, each of the resonant holes extending from the top surface of the dielectric body to the bottom surface of the dielectric body and being electrically connected to a corresponding resonant slot, wherein the resonant slot and the resonant hole which are electrically connected with each other function together as a resonator;

a pair of cavities for transmitting input/output signals, each of the cavities being located on the front surface of the dielectric body and associated with a respective one of the first and third resonant slots;

a pair of slits, each of the slits having an inner surface coated with an electrically conducting material, each of the slits being formed on the top surface of the dielectric body positioned between the resonant slots formed on the top surface of the dielectric body, thereby modulating coupling of electromagnetic fields between the resonators; and a pair of openings, each of the openings being positioned around the cavities, thereby preventing an electrical connection between the resonators during transmission of input/output signals.

2. The dielectric microwave filter of claim 1 further comprising additional resonant slots and additional resonant holes.

3. The dielectric microwave filter of claim 1 wherein all surfaces of the dielectric microwave filter are completely covered with an electrically conducting material, except for each of the openings and the top surface of the dielectric body.

4. A dielectric microwave filter comprising:

a dielectric body having top, bottom, front and rear surfaces;

a trinity of first, second and third resonant slots, each of the resonant slots being formed on the top surface of the dielectric body;

a trinity of first, second and third resonant holes, each of the resonant holes extending from the top surface of the dielectric body to the bottom surface of the dielectric body and being electrically connected to a corresponding resonant slot, wherein the resonant hole and the resonant slot which are electrically connected with each other function together as a resonator;

a pair of cavities for transmitting input/output signals, each of the cavities being located on the front surface of the dielectric body and associated with a respective one of the first and the third resonant slots; and a pair of slits, each of the slits having an inner surface coated with an electrically conducting material, each of the slits being formed on the rear surface of the dielectric body positioned between the resonant holes formed in the dielectric body, thereby modulating coupling of electromagnetic fields between the resonators.

5. The dielectric microwave filter of claim 4 further comprising additional resonant slots and additional resonant holes.

6. The dielectric microwave filter of claim 4 wherein all surfaces of the dielectric microwave filter are completely covered with an electrically conducting material, except for the front surface and the top surface of the dielectric body.

7. A dielectric microwave filter comprising:

a dielectric body having top and front surfaces;

a trinity of first, second and third resonant slots, each of the resonant slots being formed on the top surface of the dielectric body, wherein an end of each of the resonant slots is electrically connected to ground and wherein at least two of said resonant slots do not extend across the entire top surface and have at least one end wall defined by said dielectric body;

a pair of cavities for transmitting input/output signals, each of the cavities being located on the front and top surfaces of the dielectric body and associated with a respective one of the first and the third resonant slots; and a pair of slits, each of the slits having an inner surface coated with an electrically conducting material, each of the slits being formed on the front surface of the dielectric body positioned between the resonant slots formed on the top surface of the dielectric body thereby modulating coupling of electromagnetic fields between the resonant slots.

8. The dielectric microwave filter of claim 7 further comprising additional resonant slots.

9. The dielectric microwave filter of claim 7 wherein all surfaces of the dielectric microwave filter are completely covered with an electrically conducting material, except for the front surface and the top surface of the dielectric body.

10. A dielectric microwave filter comprising:

a dielectric body having top, front and rear surfaces;

a trinity of first, second and third resonant slots, each of the resonant slots being formed on the top surface of the dielectric body, wherein an end of each of the resonant slots is electrically connected to ground and wherein at least two of said resonant slots do not extend across the entire top surface and have at least one end wall defined by said dielectric body;

a pair of cavities for transmitting input/output signals, each of the cavities being located on the front and top surfaces of the dielectric body and associated with a respective one of the first and the third resonant slots; and a pair of slits, each of the slits having an inner surface coated with an electrically conducting material, each of the slits being formed on the rear surface of the dielectric body positioned between the resonant slots formed on the top surface of the dielectric body, thereby modulating coupling of electromagnetic fields between the resonant slots.

11. The dielectric microwave filter of claim 10 further comprising additional resonant slots.

12. The dielectric microwave filter of claim 10 wherein all surfaces of the dielectric microwave filter are completely covered with an electrically conducting material, except for the front surface and the top surface of the dielectric body.

13. A dielectric microwave filter comprising:

a dielectric block having a least one surface;

a plurality of resonant slots extending only partially across said surface, wherein each of said resonant slots has at least one end wall defined by said dielectric block; and a separate pair of input/output cavities also being formed in said surface, each said cavity being associated with a respective one of the resonant slots for coupling signals thereto or therefrom.

14. A dielectric microwave filter as in claim 13 including at least one slit formed on said surface and positioned between at least one pair of said resonant slots to control the coupling of electromagnetic fields therebetween.

15. A dielectric microwave filter as in claim 13 wherein said dielectric block includes other surfaces and wherein at least one slit is formed in at least one of said other surfaces and positioned between at least one pair of said resonant slots to control the coupling of electromagnetic fields therebetween.

16. A dielectric microwave filter as in claim 15 wherein said input/output cavities also intersect and reside within one of said other surfaces.

17. A dielectric microwave filter as in claim 16 wherein said dielectric block is completely covered with an electrically conducting material except for said surface and said one of the other surfaces.

18. A dielectric microwave filter as in claim 13 wherein said dielectric block is partially covered with an electrically conducting material, said surface on which the resonant slots reside not being so covered.

* * * * *